US008737826B2

(12) United States Patent
Stauffer et al.

(10) Patent No.: US 8,737,826 B2
(45) Date of Patent: May 27, 2014

(54) HIGH PRESSURE SMOKE MACHINE

(75) Inventors: Gene Stauffer, Moreno Valley, CA (US); Kenneth Pieroni, Yorba Linda, CA (US)

(73) Assignee: Redline Detection, LLC, Placentia, CA (US)

( * ) Notice: Subject to any disclaimer, the term of this patent is extended or adjusted under 35 U.S.C. 154(b) by 223 days.

(21) Appl. No.: 13/230,711

(22) Filed: Sep. 12, 2011

(65) Prior Publication Data

US 2012/0201522 A1 Aug. 9, 2012

Related U.S. Application Data

(60) Provisional application No. 61/382,110, filed on Sep. 13, 2010.

(51) Int. Cl.
*B05B 1/24* (2006.01)

(52) U.S. Cl.
USPC ..... 392/386; 392/395; 392/401; 392/403; 239/136; 73/40.7

(58) Field of Classification Search
None
See application file for complete search history.

(56) References Cited

U.S. PATENT DOCUMENTS

| | | | | | |
|---|---|---|---|---|---|
| 3,024,200 | A * | 3/1962 | Smith | 392/392 |
| 3,234,357 | A | 2/1966 | Seuthe | |
| 4,764,660 | A | 8/1988 | Swiatosz | |
| 4,818,843 | A | 4/1989 | Swiatosz | |
| 5,022,435 | A | 6/1991 | Jaw-Shiunn | |
| 5,107,698 | A * | 4/1992 | Gilliam | 73/40.7 |
| 5,647,054 | A | 7/1997 | Jones | |
| 5,753,800 | A * | 5/1998 | Gilliam | 73/40.7 |
| 5,859,363 | A | 1/1999 | Gouge | |
| 5,922,944 | A | 7/1999 | Pieroni et al. | |
| 5,937,141 | A | 8/1999 | Swiatosz | |
| 6,018,615 | A | 1/2000 | Loblick | |
| 6,142,009 | A | 11/2000 | Loblick | |
| 6,175,987 | B1 | 1/2001 | Harvey | |
| 6,361,752 | B1 | 3/2002 | Demarest et al. | |
| 6,392,227 | B1 | 5/2002 | Banyard | |
| 6,439,031 | B1 | 8/2002 | Pieroni et al. | |
| 6,477,890 | B1 * | 11/2002 | Hulsebus | 73/40.7 |
| 6,526,808 | B1 | 3/2003 | Pieroni et al. | |
| 6,907,771 | B2 * | 6/2005 | Finlay et al. | 73/40.7 |
| 7,305,176 | B1 * | 12/2007 | Pieroni | 392/395 |
| 2005/0044930 | A1 * | 3/2005 | Finlay et al. | 73/40.7 |
| 2007/0297774 | A1 * | 12/2007 | Pieroni | 392/395 |

OTHER PUBLICATIONS

Patent Cooperation Treaty International Search Report; PCT/US2011/51444; mailed Feb. 1, 2012; 6 pages.

* cited by examiner

*Primary Examiner* — Joseph M Pelham
(74) *Attorney, Agent, or Firm* — Stetina Brunda Garred & Brucker

(57) ABSTRACT

There is provided a smoke generating device for use with a vaporizing material. The smoke generating device includes a housing defining an inner chamber configured to receive the vaporizing material, and a heating element disposed within the housing. A capillary is disposed within the inner chamber and is in thermal communication with the heating element. The capillary includes opposed first and second end portions, with the first end portion being disposable in the vaporizing material and the second end portion defining an opening in fluid communication with the internal chamber. The capillary is configured to convey the vaporizing material to the heating element. An inlet conduit in fluid communication with the inner chamber and fluidly connectable to a pressurized fluid source, and an outlet conduit in fluid communication with the inner chamber and configured to convey vapor from the inner chamber.

20 Claims, 1 Drawing Sheet

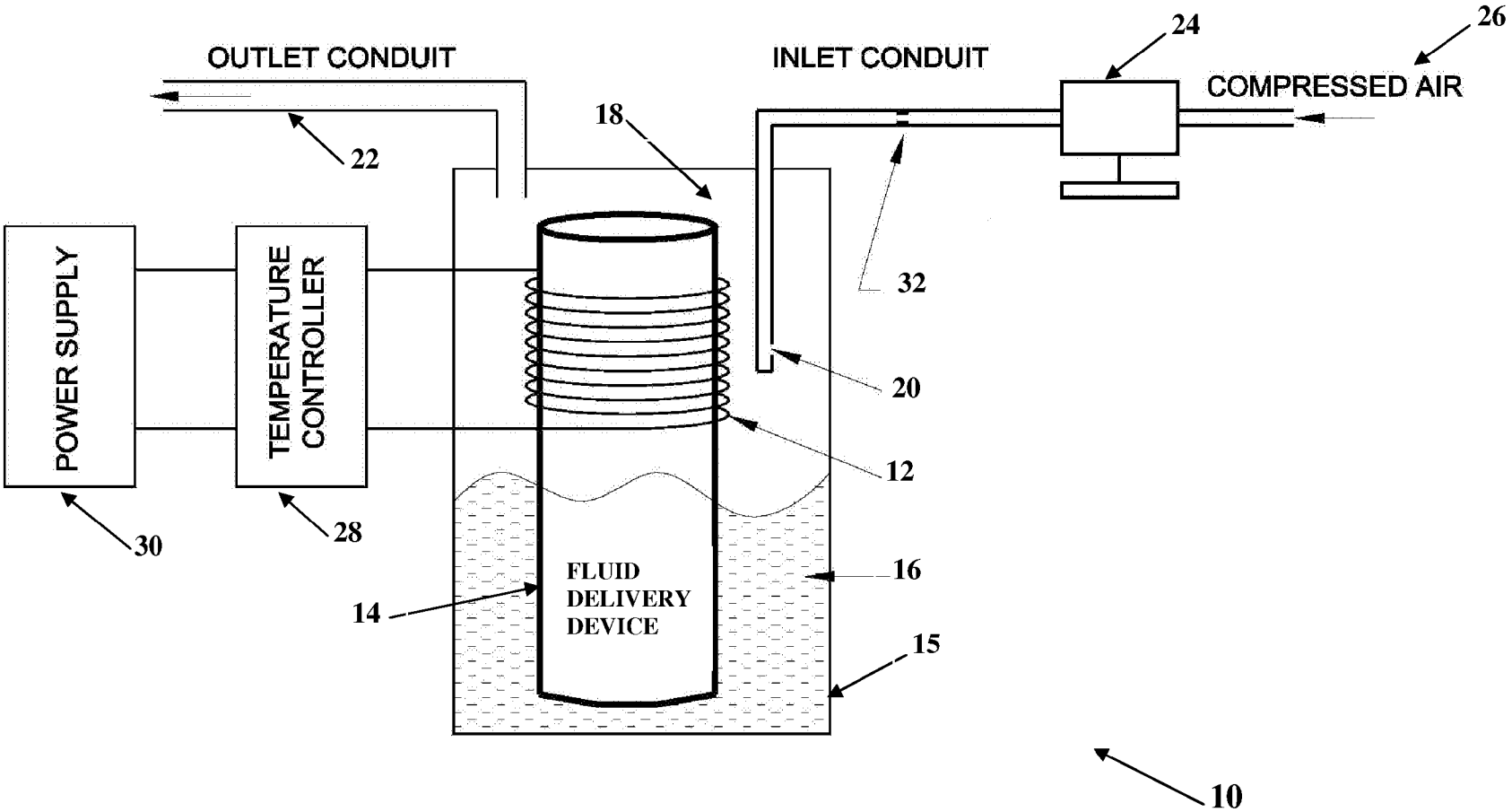
26
COMPRESSED AIR
24
10
INLET CONDUIT
32
20
12
16
15
18
FLUID
DELIVERY
DEVICE
OUTLET CONDUIT
22
14
TEMPERATURE
CONTROLLER
28
POWER SUPPLY
30

HIGH PRESSURE SMOKE MACHINE

CROSS-REFERENCE TO RELATED APPLICATIONS

This application claims the benefit of U.S. Provisional Application No. 61/382,110, filed Sep. 13, 2010.

STATEMENT RE: FEDERALLY SPONSORED RESEARCH/DEVELOPMENT

Not Applicable

BACKGROUND

1. Field of the Invention

The present invention relates generally to a vapor generating device used while testing the fluid integrity of a fluid system, and more specifically to a vapor generating device that can safely produce a vapor at high pressures.

2. Description of the Prior Art

A visible vapor or smoke produced under controlled conditions which provide the ability to start and stop the vapor generation, to vary the flow of the vapor and to regulate the pressure of the vapor can be employed in many useful and beneficial ways. Such apparatus are well documented in the prior art and have been employed for various applications such as; air flow studies, theatrical effects, simulation of battlefield or structure fire conditions for training purposes, visibility obstruction, camouflage and to determine the presence and location of leaks in a vessel or conduit by observation of the vapor egress. Exemplary of such prior art systems include those disclosed in Great Britain Patent Specification 1,039,729 entitled SMOKE GENERATOR, published Aug. 17, 1996; Great Britain Patent Specification 1,064,234 entitled IMPROVEMENTS IN FLUID HEATING APPARATUS PARTICULARLY FOR SMOKE GENERATIONS OR THE LIKE, published Apr. 5, 1967; Great Britain Patent Specification 1,243,381 entitled IMPROVEMENTS IN SMOKE GENERATORS, published Aug. 18, 1971; Great Britain Patent Specification 640,266 entitled AN IMPROVED METHOD AND APPLIANCE FOR CREATING ARTIFICIAL FOG, MIST OR SMOKE, published Jul. 19, 1950; and Great Britain Patent Specification 1,258,266 entitled PROCESS OF SEALING, DETECTING AND/OR LOCATING LEAKS, published Dec. 30, 1971, the teachings of all of which are expressly incorporated herein by reference.

These apparatus utilize various materials, usually with the application of heat, to produce a dense vapor that is then admixed with a propellant gas of various type and expelled into the environment where the properties of the vapor are to be exploited. The selection of a material to vaporize is dependent on the application and environment in which the vapor is to be used. For instance, solutions of water and glycerin and glycol in various proportions are common and may be used for theatrical purposes where persons may be exposed to breathing the vapor for long periods of time and where the moisture from the water vapor will not damage the area where the vapor is applied. The chemical compound titanium tetrachloride ($TiCl_4$) produces a fine white vapor when exposed to moisture in the air; however, the material and its vapors are highly corrosive and it must be deployed carefully and in small quantities lest the corrosiveness cause damage. Petroleum or paraffin oils such as mineral oil may be utilized in applications where a dense vapor with a long persistence (amount of time required to dissipate) is required and the application is resistant to the effects of hydrocarbons.

Most apparatuses are intended to expel vapor into the surrounding environment as when used for air flow study, visual obstruction, theatrical, and training purposes. These apparatus expel vapor at or near atmospheric pressure using a driven fan or pump, or alternately, a compressed gas such as air, nitrogen or carbon dioxide ($CO_2$), to admix air or other gas and the vapor and propel the mixture into the surrounding area. Pyrotechnic devices are also used in such applications but lack the useful control abilities described previously.

Furthermore many applications exist where the vapor is injected into a closed vessel or conduit for the purpose of determining the presence and location of an opening or leak in the vessel or conduit. The injection pressure of the vapor must be controlled in these applications as excessive pressure may damage the vapor generating device or the vessel or conduit into which the vapor is injected.

One such application is the determination and location of leaks effecting the operation of internal combustion engines and the pollution causing emissions of the engines and associated systems. For instance, leaks in the fuel vapor recovery system (commonly known as the EVAP System) utilized with gasoline powered passenger vehicles are known to be a significant source of hydrocarbon pollution as the leak allows raw hydrocarbon evaporating from the fuel to escape to the surrounding atmosphere. A common method for locating the leak within this system is to inject a suitable vapor into the system and observe for the vapor egress. Since the system is initially designed to handle hydrocarbon fuels, a vapor produced by heating mineral oil, also a hydrocarbon, is typically used to assure compatibility. However, one must take care in pressurizing this system as most are designed to contain a maximum of one pound per square inch (1 PSI). Additionally, the US Environmental Protection Agency specifies an inspection test pressure of 12 to 14 inches of water column (approximately 0.47 PSI). There is a plurality of products available that conform to these requirements.

A second common application is the detection and location of leaks in an internal combustion engine's fuel and air induction system. Such leaks upset the delicate ratio of fuel to air induced into the engine reducing the engine's performance and efficiency while increasing pollution causing emissions. Various devices and apparatus are well known in the art and products conforming to the requirements for testing fuel vapor recovery systems are very capable of performing an inspection of most induction systems. Some apparatus employed for this application can develop pressures as high as 2 PSI and are therefore not suitable for fuel vapor recovery system inspection.

Internal combustion engine technology is advancing to improve performance and efficiency. One method coming into common usage is to increase an engine's fuel and air induction system pressure. Normally this system is in vacuum or negative pressure drawing fuel and air into the combustion chamber. This type of engine is known as a vacuum induced or self aspirated engine. To increase the induction system pressure a turbocharger which utilizes exhaust gas pressure to rotate an impeller that in turn rotates a second impeller, imparting energy and thus pressure to the induction system air stream is commonly employed and can increase the induction system pressure to as high 30 PSI. This forces a greater quantity of fuel and air into the combustion chamber where a greater quantity of energy can be derived from the fuel.

In a forced induction engine, induction system leaks are more critical then in vacuum induced engines and thus must be detected, located and repaired to assure the highest possible performance and efficiency. The devices and apparatus developed for the inspection of fuel vapor recovery and vacuum induction systems are not always adequate for use in a high pressure forced induction system. Elastic connections between components may remain sealed under the low pressures of 0.47 PSI to 2 PSI. However, these connections will dislocate and leak when exposed to the higher pressure of the forced induction system.

Thus there is a need for a vapor generating device that can safely produce a controlled vapor at pressures up to and exceeding 30 PSI. Additionally this vapor must be compatible with all systems of, and used in conjunction with, internal combustion engines. To assure system compatibility, mineral oil vapor is the preferred choice. However when mineral oil vapor is subjected to the combination of elevated pressure and the high temperature required to produce the vapor, spontaneous combustion or dieseling is prone to occur, causing significant damage to the vapor generating apparatus and possibly the engine and vehicle to which it is connected.

Significant prior art exists teaching the use of inert gas propellants such as nitrogen ($N_2$) or carbon dioxide ($CO_2$) to eliminate the oxidizing effect of air and thus inhibit the ignition of the vapor within the vapor generating apparatus. Exemplary of such prior art references include the aforementioned prior art, and in particular Great Britain Patent Specification 640,266 that generates smoke by projecting an atomized spray of glycerin, oil or other liquid by means of a jet of carbon dioxide or nitrogen under pressure onto a surface, such as the wall of a cylinder, heated to a temperature sufficiently elevated to cause immediate vaporization of the liquid. In fact, much of the prior art teaches that there is a real potential for fire or explosion if inert gas propellants are not used, as suggested by aforementioned Great Britain Patent Specifications 640,266 and 1,039,729 as well as U.S. Pat. No. 6,526,808 entitled SMOKE AND CLEAN AIR GENERATING MACHINE FOR DETECTING PRESENCE AND LOCATION OF LEAKS IN A FLUID SYSTEM, the teachings of which are likewise incorporated by reference.

However, the storage and use of gases under high pressure presents a significant hazard in the working environment of an engine service facility. There is a genuine danger of asphyxiation should a leak occur in a closed environment and many deaths have been documented. Additionally failure to properly store, handle and transport the high pressure storage vessels can result in damage to the storage vessel causing it to become a projectile capable of penetrating a masonry wall. Obviously an object with this amount of energy is capable of causing great bodily harm and property damage. Further there is a significant added expense to purchasing and storing these gases and the dangers and costs are compounded because of the large quantities required to support the large flow rates produced with the higher pressures.

Thus there is a further need for a vapor generating apparatus that can safely produce vapor, of a composition such as mineral oil, at higher pressures while utilizing compressed air as the propellant.

One method used since the early 2000's is to employ a pressure sensing device such as a pressure switch to extinguish the heat source when pressures within the vapor generating chamber exceed approximately 5 PSI. The pressure continues to increase to the desired inspection pressure but the extinguished heat source begins cooling quickly and combustion of the vapor is prevented. Although this is an effective method it also results in a decreased vapor density at the desired test pressure. A lower density vapor is less visible and therefore less effective for the purpose of leak identification and location. A similar technique commonly utilized is to first fill the vessel or conduit with vapor and then apply compressed air to reach the desired test pressure. This technique results in the same less effective lower density vapor.

As is apparent from the foregoing, there is a need in the art for a vapor generating device for safely generating vapor for use in high pressure fluid systems. The present invention addresses this particular need, as will be discussed in more detail below.

BRIEF SUMMARY

There is provided a smoke generating device for use with a vaporizing material. The smoke generating device includes a housing defining an inner chamber configured to receive the vaporizing material, and a heating element disposed within the housing. A capillary is disposed within the inner chamber and is in thermal communication with the heating element. The capillary includes opposed first and second end portions, with the first end portion being disposable in the vaporizing material and the second end portion defining an opening in fluid communication with the internal chamber. The capillary is configured to convey the vaporizing material to the heating element. An inlet conduit in fluid communication with the inner chamber and fluidly connectable to a pressurized fluid source, and an outlet conduit in fluid communication with the inner chamber and configured to convey vapor from the inner chamber.

The smoke generating device may be configured to operate at pressures up to an exceeding 30 PSI without dieseling.

The heating element may include a heating coil in thermal communication with the capillary, and a temperature controller in electrical communication with the heating element for controlling the temperature of the heating element.

The smoke generating device may further include a pressure regulator in fluid communication with the inlet conduit, wherein the pressure regulator is configured to control the pressure of the fluid delivered to the inner chamber.

The smoke generating device may additionally include a flow restrictor in fluid communication with the inlet conduit to control fluid flow therethrough. The fluid flow rate through the inlet conduit may correspond to fluid flow rate through the outlet conduit.

The smoke generating device may be configured to vaporize the vaporizing material between 225 degrees Fahrenheit and 450 degrees Fahrenheit.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 1 is a schematic drawing of one embodiment of a high pressure smoke machine.

DETAILED DESCRIPTION

The current embodiment of the instant invention is configured for leak determination and location in internal combustion engines with forced induction systems up to 30 PSI. There are additional applications that will benefit from the ability to easily provide a pressurized vapor under controlled conditions to identify leaks. Similar embodiments will provide the capability to inspect applications such as; vehicle air break systems, engine combustion chambers, engine cooling systems, "super charged" engines (a higher pressure form of forced induction) and exhaust systems.

The required pressure and materials are established by the application in which the vapor is to be employed and as stated it is desirable to utilize compressed air as the propellant safely and reliably. To achieve this, the remaining variables of temperature and fuel to air ratio must be controlled to prevent dieseling. Of these temperature is the simplest to modify; however, simply reducing the temperature will also reduce the vapor density and therefore the effectiveness of the vapor.

Furthermore, air flow through the apparatus varies with the application and with time and with system leakage. Flow rates may vary from zero to over 60 liters per minute with the higher flow rates producing a cooling effect on the heating device. Should an apparatus make use of a heating device configured for a fixed or constant power dissipation, as in most prior art, the device must be configured to remain below the vapor ignition temperature at a zero flow rate. This flow rate represents the highest pressure and therefore, as is known in the art, the lowest ignition temperature. As flow increases through the apparatus the heating device will be cooled and vapor density will decrease to an unacceptable level. This necessitates the use of an active temperature control system to adjust the heating device power dissipation in response to varying operating conditions while maintaining the heating device temperatures below the vapor ignition temperature yet high enough to produce suitable vapor. Temperature controlled heaters first appear in the prior art in U.S. Pat. No. 7,305,176 B1.

It has been observed that mineral oil will begin producing vapor at temperatures as low as 225 degrees Fahrenheit; however, to produce useable amounts of vapor, the products of prior art operate at temperatures ranging from 450 degrees Fahrenheit to well in excess of 1,000 degrees Fahrenheit. It has also been observed that mineral oil vapor will spontaneously combust or diesel at temperatures of about 450 degrees Fahrenheit when subjected to pressures of 5 PSI to 7 PSI. These values set the frame work for the instant invention, setting the minimum vaporization temperature to be above 225 degrees Fahrenheit and the maximum vaporization temperature to be below 450 degrees Fahrenheit. The maximum vaporization temperature will require further downward adjustment as operating pressures are increased above those observed.

Various embodiments of the instant invention include an electrically powered heating coil 12 positioned radially along a capillary device 14 which conveys the material to be vaporized 16 to the heating coil 12. The heating coil 12 and capillary 14 are secured to a housing 15 within a sealed chamber 18 with provisions for an inlet conduit 20 and outlet conduit 22. The sealed chamber 18 additionally provides a reservoir or other suitable means to supply the capillary 14 with material to be vaporized 16. The inlet conduit 20 is connected to a pressure regulator 24 with means to adjust and control the pressure delivered to the chamber 18. The inlet to the pressure regulator 24 is connected to a pressured fluid source 26, such as compressed air. Other gases such as $N_2$ and $CO_2$ will function with the instant invention but an objective of the invention is to eliminate the need for these gases and their associated hazards and expense. The outlet conduit 22 provides means of conveying the vapor and admixed propellant gas to a fluid system to be evaluated. The heating coil 12 is connected to a temperature control system 28 and power source 30 located outside the sealed chamber 18.

The heating coil 12 is designed to provide a large surface area. In the instant invention the heater surface area is approximately 3.6 to 3.9 square inches compared to approximately 0.3 square inch in apparatus which employ a cartridge type heater such as a diesel engine glow plug. The large surface area produces a greater amount of vapor at a lower temperature of approximately 400 degrees Fahrenheit whereas the smaller heaters require higher operating temperatures to produce usable amounts of vapor under the required flow conditions. The current embodiment of the instant invention can operate reliably at pressures up to and exceeding 30 PSI without dieseling. Further increase of the heating surface will likely increase safe operating pressure to in excess of 80 PSI.

In the instant invention air flows through the inlet conduit 20 and is directed into the sealed chamber 18 but away from the heating coil 12. The air flow path is such that turbulence is created equalizing air flow around the heating coil 12. This may be by way of a single or multiple direction control nozzles. The internal shape of the sealed chamber 18 is also instrumental in creating the required flow patterns. The internal shape may be round or elliptical or rectangular with air flows directed away from the heating coil 12 or tangential to the chamber wall.

Prior apparatus have directed the air flow directly at the heating coil or cartridge heater. In most previous apparatuses this air flow is also used to convey the oil to the heater to be vaporized. Directing the air flow with or without the material to be vaporized directly at the heater causes localized cooling of the heating device. The temperature control systems used in prior and the instant apparatus sense the average temperature of the heater; therefore localized cooling effects are offset by localized heating effects. These higher temperature areas can exceed the ignition temperature of the vapor and produce dieseling. The turbulent air flow around the heater distributes the cooling effect of the air flow thus minimizing any localized heating effect.

In the instant invention the volume of the sealed chamber 18 is the minimum possible to contain the heating coil 12, capillary 14, vaporization material supply means, inlet conduit 20 and outlet conduit 22. As previously stated, the instant invention utilizes a capillary 14 to continuously convey the material to be vaporized 16 to the heater 12 and the heater temperature is held constant by the temperature control system 28, thus vapor generation is relatively constant and independent of air flow. As flow rates decline due to increased pressure in the outlet conduit 22, air flow into the sealed chamber 18 through the inlet conduit 20 also declines. Since the rate of vapor generation remains constant, the vapor (fuel) to air ratio within the sealed chamber 18 richens (increased fuel to air ratio) and ignition of the vapor is made more difficult. Therefore as the operating conditions of the apparatus increase the pressure within the sealed chamber 18, a greater likelihood of dieseling occurs. However, at the same time, the increased fuel to air ratio decreases or offsets the likelihood of dieseling. Larger chambers contain a greater volume of air making it more difficult to achieve this rich fuel to air ratio.

A flow restrictor 32 incorporated in the inlet conduit 20 of approximately 0.001 to 0.003 square inch creates changes in the pressure within the sealed chamber 18 at various flow rates further preventing dieseling. When flow through the apparatus is at maximum the amount of air entering the sealed chamber 18 is also at its maximum. This can produce an ignitable fuel to air ratio of the vapor. However, the air flow through the restriction causes a reduction of the pressure within the sealed chamber 18 thus preventing ignition as the combination of pressure and temperature are required to ignite the vapor. As flow decreases, due to an equalizing of pressures between the vessel or conduit being evaluated and the apparatus, the pressure within the sealed chamber 18 will increase. However, since this can only occur at low flow rates the fuel to air ratio within the sealed chamber 18 will increase; therefore, preventing the ignition of the vapor. This restriction may be incorporated into the flow direction control nozzle or be a separate component of the inlet conduit 20.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

Along there lines, although particularly envisioned for use in detecting leaks in automotive based systems, it is contemplated that the smoke generating and leak detecting systems and methods disclosed herein may be useful for any of a wide variety of applications where it is ideal to produce a controlled vapor at pressures of up to and exceeding 30 PSI.

What is claimed is:

1. A smoke generating device for use with a vaporizing material, the smoke generating device comprising:

a housing defining an inner chamber configured to receive the vaporizing material;

a heating element disposed within the housing;

a fluid delivery device disposed within the inner chamber and in thermal communication with the heating element, the fluid delivery device having opposed first and second end portions, the first end portion being disposable in the vaporizing material and the second end portion defining an opening in fluid communication with the internal chamber, the fluid delivery device being configured to convey the vaporizing material to the heating element;

an inlet conduit in fluid communication with the inner chamber and fluidly connectable to a pressurized fluid source; and an outlet conduit in fluid communication with the inner chamber and configured to convey vapor from the inner chamber;

the heating element and fluid delivery device being configured to generate vapor when the pressure within the inner chamber is 30 PSI.

2. The smoke generating device as recited in claim 1, wherein the heating element includes a heating coil in thermal communication with the fluid delivery device, and a temperature controller in electrical communication with the heating element for controlling the temperature of the heating element.

3. The smoke generating device as recited in claim 2, further comprising a power supply in electrical communication with the temperature controller.

4. The smoke generating device as recited in claim 1, further comprising a pressure regulator in fluid communication with the inlet conduit, the pressure regulator being configured to control the pressure of the fluid delivered to the inner chamber.

5. The smoke generating device as recited in claim 1, wherein the smoke generating device is configured to vaporize the vaporizing material between 225 degrees Fahrenheit and 450 degrees Fahrenheit.

6. The smoke generating device as recited in claim 1, wherein the heating element defines a surface area of approximately 3.6 to 3.9 square inches.

7. The smoke generating device as recited in claim 1, wherein the inlet conduit is configured to direct fluid away from the heating element and induce turbulence within the inner chamber to dissipate the fluid from the inlet conduit around the heating element.

8. The smoke generating device as recited in claim 1, further comprising a flow restrictor in fluid communication with the inlet conduit to control fluid flow therethrough.

9. The smoke generating device as recited in claim 8, wherein the flow restrictor is configured to control the fluid flow rate through the inlet conduit based upon the fluid flow rate through the outlet conduit.

10. The smoke generating device as recited in claim 1, wherein the heating element is radially disposed about the capillary.

11. A high pressure smoke machine comprising:

a housing defining an inner chamber configured to receive the vaporizing material;

a heating element disposed within the housing;

a delivery device in thermal communication with the heating element, the delivery device being disposable in fluid communication with the vaporizing material and configured to convey the vaporizing material to the heating element;

an inlet conduit in fluid communication with the inner chamber and fluidly connectable to a pressurized fluid source; and an outlet conduit in fluid communication with the inner chamber and configured to convey vapor from the inner chamber;

the heating element and delivery device being configured to generate vapor when the pressure within the inner chamber is 30 PSI.

12. The smoke generating device as recited in claim 11, wherein the heating element includes a heating coil in thermal communication with the delivery device, and a temperature controller in electrical communication with the heating element for controlling the temperature of the heating element.

13. The smoke generating device as recited in claim 12, further comprising a power supply in electrical communication with the temperature controller.

14. The smoke generating device as recited in claim 11, further comprising a pressure regulator in fluid communication with the inlet conduit, the pressure regulator being configured to control the pressure of the fluid delivered to the inner chamber.

15. The smoke generating device as recited in claim 11, wherein the smoke generating device is configured to vaporize the vaporizing material between 225 degrees Fahrenheit and 450 degrees Fahrenheit.

16. The smoke generating device as recited in claim 11, wherein the heating element defines a surface area of approximately 3.6 to 3.9 square inches.

17. The smoke generating device as recited in claim 11, wherein the inlet conduit is configured to direct fluid away from the heating element.

18. The smoke generating device as recited in claim 11, further comprising a flow restrictor in fluid communication with the inlet conduit to control fluid flow therethrough.

19. The smoke generating device as recited in claim 18, wherein the fluid flow rate through the inlet conduit corresponds to fluid flow rate through the outlet conduit.

20. A high pressure smoke machine comprising:

a housing defining an inner chamber configured to receive the vaporizing material, the inner chamber having an inlet fluidly connectable with a pressurized fluid source and an outlet;

a heating element disposed within the housing; and a delivery device in thermal communication with the heating element, the delivery device being disposable in fluid communication with the vaporizing material and configured to convey the vaporizing material to the heating element;

the heating element and fluid delivery device being configured to generate vapor when the pressure within the inner chamber is 30 PSI.

* * * * *